US008983111B2

(12) United States Patent
Xi et al.

(10) Patent No.: US 8,983,111 B2
(45) Date of Patent: Mar. 17, 2015

(54) SPEAKER

(75) Inventors: Li-Shu Xi, Shenzhen (CN); Wei Zhu, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 332 days.

(21) Appl. No.: 13/528,154

(22) Filed: Jun. 20, 2012

(65) Prior Publication Data

US 2013/0011000 A1 Jan. 10, 2013

(30) Foreign Application Priority Data

Jul. 4, 2011 (CN) ..... 2011 2 0232540 U

(51) Int. Cl.
*H04R 1/00* (2006.01)
*H04R 9/02* (2006.01)
*H04R 1/24* (2006.01)

(52) U.S. Cl.
CPC ..... *H04R 9/025* (2013.01); *H04R 1/24* (2013.01); *H04R 2499/11* (2013.01)
USPC ..... 381/412; 381/396

(58) Field of Classification Search
USPC ..... 381/412, 182, 396
See application file for complete search history.

(56) References Cited

U.S. PATENT DOCUMENTS

2002/0168074 A1* 11/2002 Miyamoto et al. ..... 381/182
2006/0120551 A1* 6/2006 Enomoto et al. ..... 381/396
2007/0036387 A1* 2/2007 Chang et al. ..... 381/396

* cited by examiner

*Primary Examiner* — Duc Nguyen
*Assistant Examiner* — Phan Le
(74) *Attorney, Agent, or Firm* — Anova Law Group, PLLC

(57) ABSTRACT

A speaker of the present invention is used for converting audio electrical signals to audible sounds. The multi-magnetic circuit speaker includes a box with a sound hole, at least one magnetic circuit having at least two magnetic gaps, at least two vibrating units corresponding to the magnetic gaps, respectively, at least two pair of pads embedded in the box to electrically connecting with the two vibrating units, a terminal board engaged with the box and pressing on the two pads for conducting electrical signals to the two vibrating units. The terminal board includes a first portion, a second portion extending from the second portion and a third portion extending from the second portion.

7 Claims, 3 Drawing Sheets

SPEAKER

FIELD OF THE INVENTION

The present disclosure relates to the art of speakers and, particularly to a speaker having multi-magnetic circuits.

DESCRIPTION OF RELATED ART

With the rapid development of technologies, the design of electronic devices, such as cellular phones, PDAs (personal digital assistants), and so on, is being driven by the marketplace towards providing more and more multimedia functions. At the same time, consumer's demand has continued to push a dramatic reduction in the size of the electronic devices.

Typically, most electronic devices today include a micro-speaker with multi-magnetic circuits. The micro-speaker related to the present disclosure includes a case defining a cavity, at least one magnetic circuit unit with two magnetic gaps received in the cavity, at least two vibrating units attached on the case. Each of the vibrating units includes a voice coil partially suspended in the magnetic gap, a diaphragm directly or indirectly connected to the voice coil. The voice coil of the vibrating unit is electrically connected to an external circuit via a conductive wire of the voice coil for driving the diaphragm to vibrate along a vibrating direction.

In order to improve the performance of the micro-speaker, the micro-speaker typically includes dual-magnetic-circuit structure defining two magnetic gaps, and two voice coils corresponding to the magnetic gaps respectively. However, during the vibration of the vibrating units, a distance between the two the voice coils is too long, which directly leads the conductive wire to be fractured and leads the lifespan of the micro-speaker to be shortened.

Therefore, it is desirable to provide an improved speaker which can overcome the above-mentioned problems.

DETAILED DESCRIPTION

A speaker in accordance with an exemplary embodiment of the present invention is used for converting audio electrical signals to audible sounds. The speaker includes a box with a sound hole, a magnetic circuit including at least two magnetic gaps, at least two vibrating units corresponding to the magnetic gaps, respectively, at least a pair of welding pads embedded in the box to electrically connecting with the vibrating units, a terminal board engaged with the box and contacting the welding pads for conducting electrical signals to the vibrating units.

Figure 1:
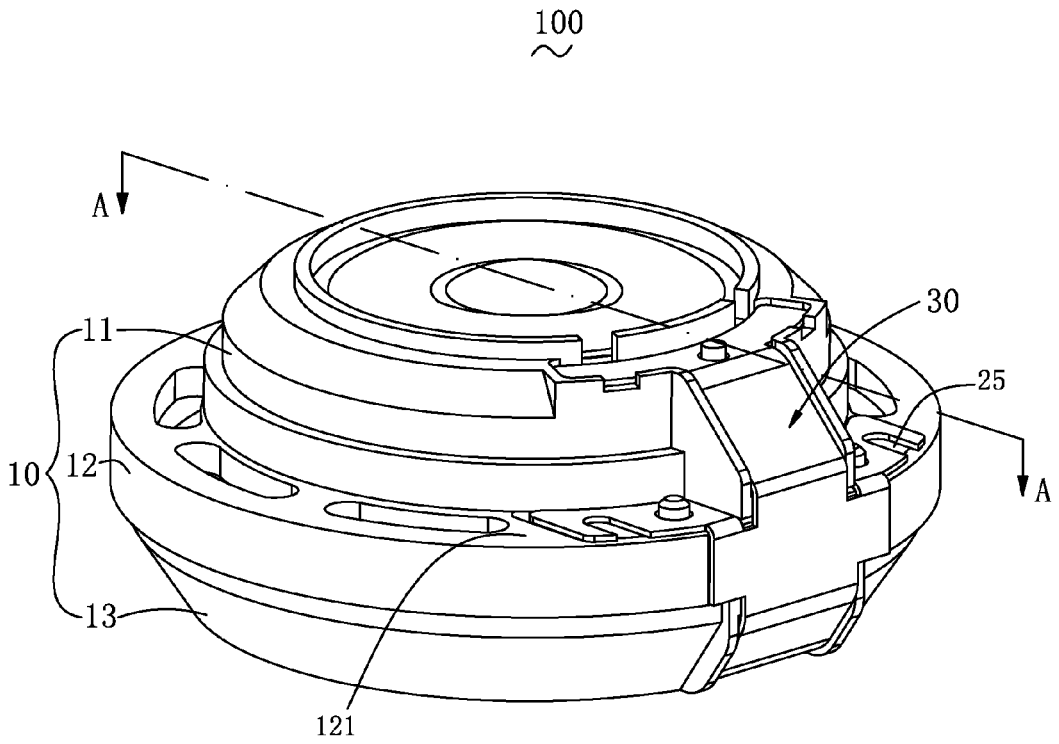
FIG. 1 is an isometric view of a speaker in accordance with an exemplary embodiment of the present invention.
Figure 2:
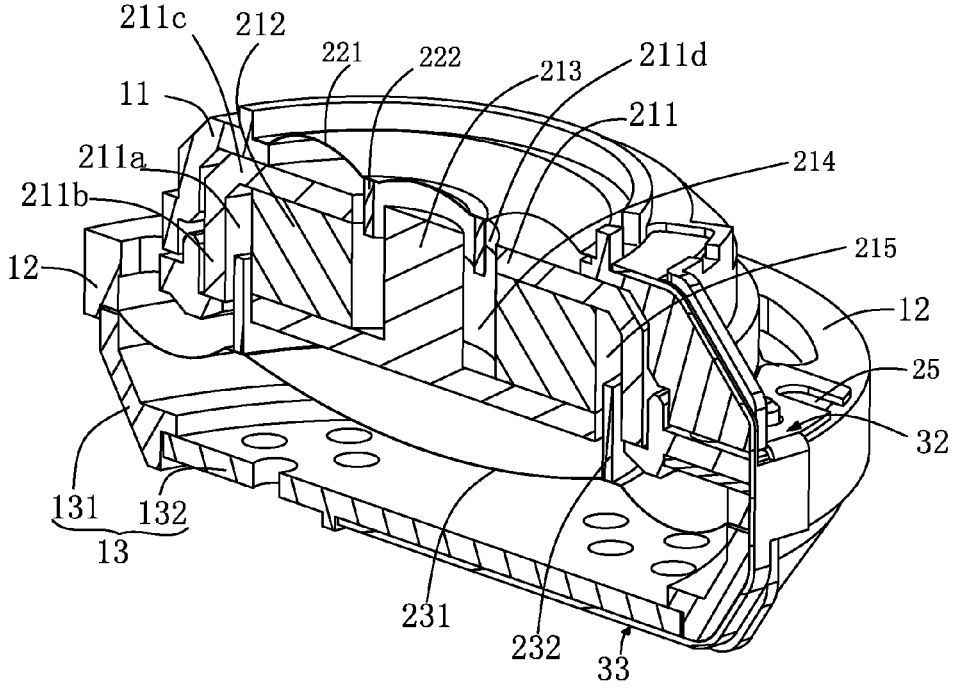
FIG. 2 is a cross-sectional view of the speaker taken along line A-A in FIG. 1.
Figure 3:
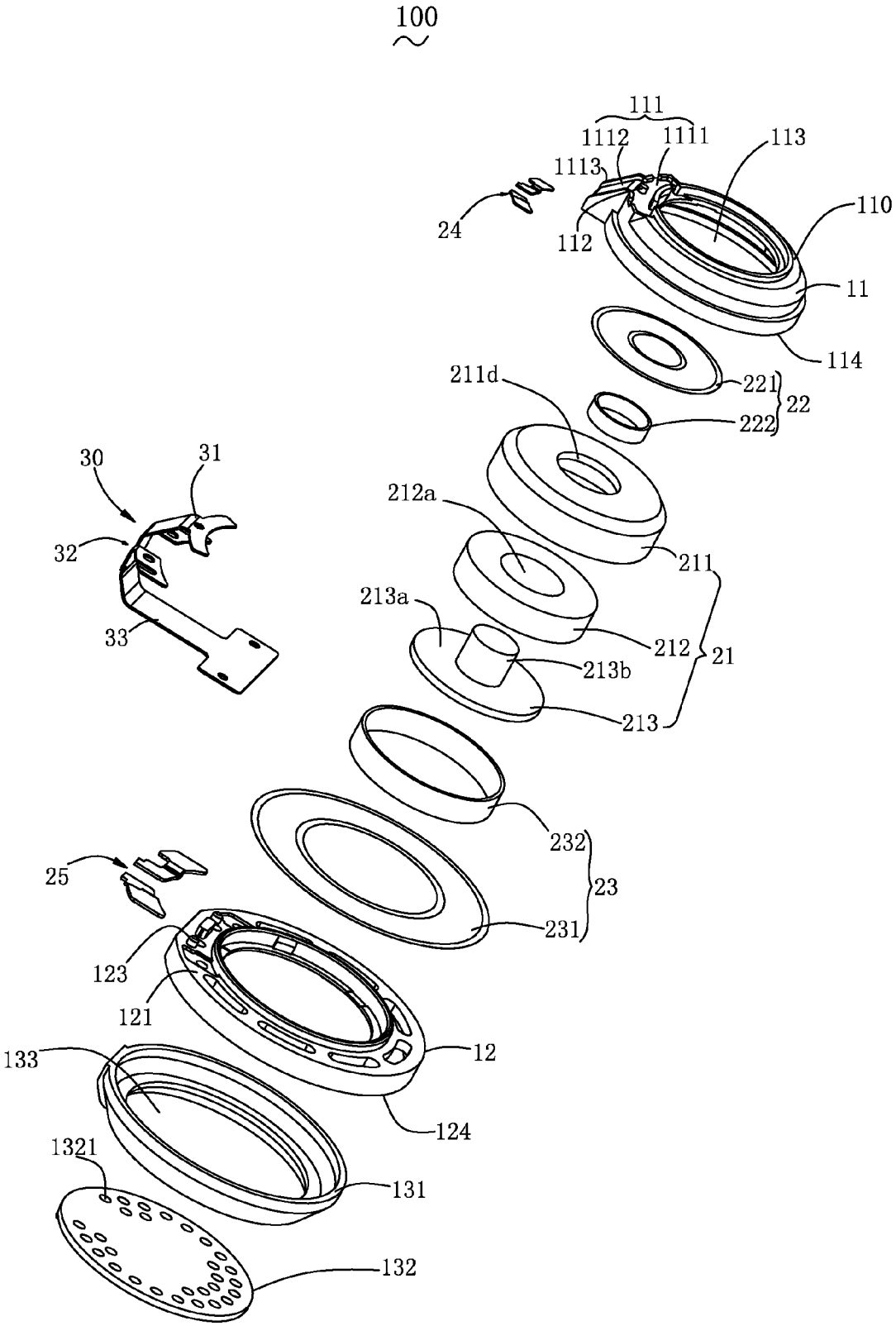
FIG. 3 is an exploded view of the speaker in FIG. 1.

Referring to FIGS. 1-3, a speaker 100, in accordance with an exemplary embodiment of the present disclosure, includes a magnetic circuit unit 21, a first vibrating unit 22, a second vibrating unit 23, a box 10 including a cover 11, a frame 12 and a case 13. The box forms a cavity for accommodating the magnetic circuit unit 21 and the two vibrating units 22, 23 therein. The speaker 100 further includes a pair of first pads 24 and a pair of second pads 25 respectively mounted on the cover 11 and the frame 12 for electrically connecting with the first vibrating unit 22 and the second vibrating unit 23. In addition, the speaker 100 includes a terminal board 30 mounted on an outer surface of the box 10.

The cover 11 includes an upper end 110 coupled to the first vibrating unit 22, and a lower end 114 opposite to the upper end 110 for being coupled to a upper surface 121 of the frame 12, whereby, a first receiving space 113 is formed by the cover 11 together with the frame 12, for receiving the magnetic circuit unit 21 and the first vibrating unit 22 therein. Furthermore, the frame 12 is annular, and further includes a connecting surface 124 opposite to the upper surface 121 attached to the case 13. The case 13 is approximately oblong bowl-shaped, and includes a lid 132, a bucket 131. A second receiving space 133 is accordingly formed by the lid 132 cooperatively with the bucket 131. The lid 132 includes a plurality of sound holes 1321. The second vibrating unit 23 is received in the second receiving space 133 of the case 13.

The magnetic circuit unit 21 includes a yoke 211, an annular magnet 212 positioned in the yoke 211, and a T-shaped member 213 attached to a top surface of the magnet 212. The magnetic circuit unit 21 is used for providing substantially closed magnetic field. The yoke 211 has a receiving room 211*a* bounded by a sidewall 211*b* and a bottom 211*c*. The magnet 212 is received in the receiving room 211*a*. The bottom 211*c* of the yoke 211 defines a central hole 211*d*. The magnet 212 forms a channel 212*a* corresponding to the central hole 211*d* of the yoke. The T-shaped member 213 includes a base 213*a* and a central pole 213*b* extending from the center of the base 213*a*. While assembled, the base 213*a* of the T-shaped member 213 attached to the top surface of the annular magnet 212 with the central pole 213*b* accommodated in the channel 212*a* of the annular magnet 212. Furthermore, a diameter of the base 213*a* of the T-shaped member 213 is equal to an outer diameter of the annular magnet 212. A diameter of the central hole of the yoke 211 is equal to the diameter of the channel 212*a* of the annular magnet 212, and a diameter of the central pole 213*b* is smaller than the diameter of the channel 212*a*. While assembled, a first magnetic gap 214 is formed between the central pole 213*b* of the T-shaped member 213 and the inner side of the annular magnet 212, and a second magnetic gap 215 is formed between the sidewall 211*b* of the yoke 211 and the outer side of the annular magnet 212.

The first vibrating unit 22 includes a first diaphragm 221 and a first voice coil 222 directly or indirectly coupled to the first diaphragm 221. While assembled, the first coil 222 is suspended in the first magnetic gap 214, and a periphery edge of the first diaphragm 221 is fixed to the upper end 110 of the cover 11.

The second vibrating unit 23 includes a second voice coil 232, a second diaphragm 231 directly or indirectly coupled to the second voice coil 232. While assembled, the second voice coil 232 is partially received in the second magnetic gap 215, and a periphery edge of the second diaphragm 231 is fixed to the frame 12.

Figure 4:
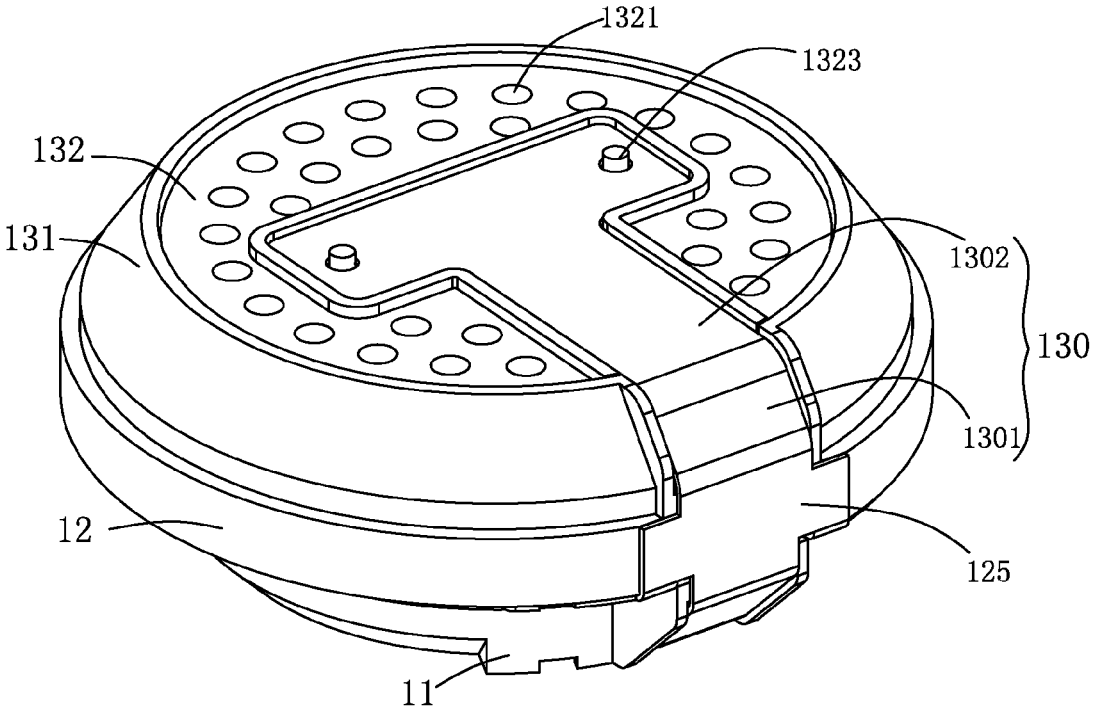
FIG. 4 is an isometric view of the speaker in FIG. 1, with a terminal board thereof being removed away.
Figure 5:
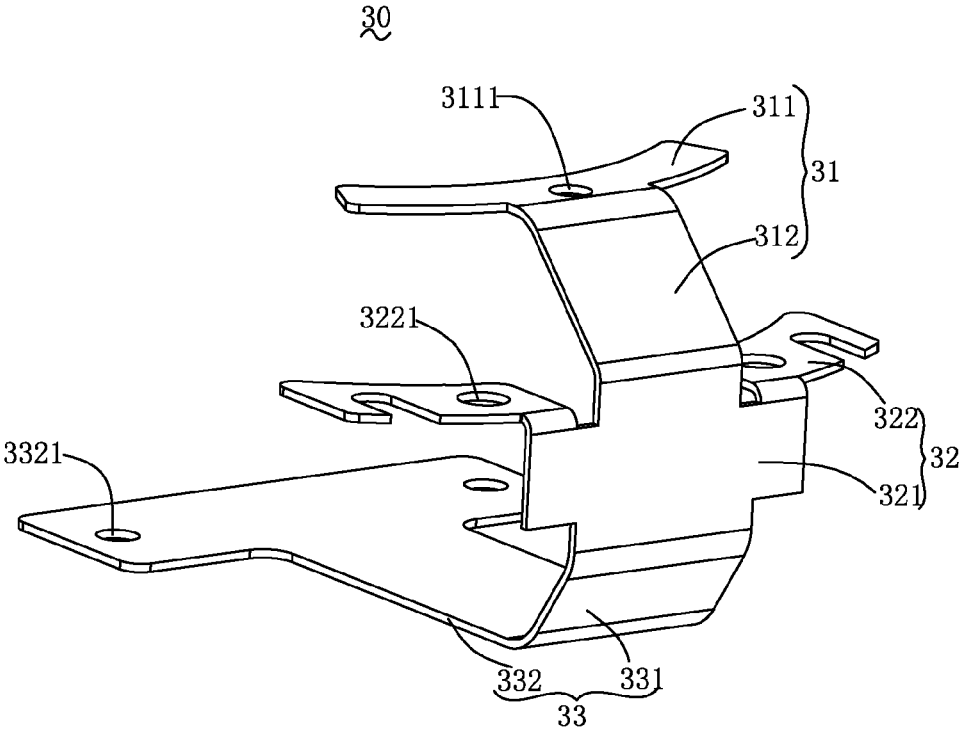
FIG. 5 is an isometric view of a terminal board of the speaker in FIG. 1.

Referring to FIGS. 3-5, especially to FIG. 5, the terminal board 30 includes a first portion 31, a second portion 32 extending from the first portion 31, and a third portion 33 extending from the second portion 32. In the present embodiment, the first portion 31 further includes a first main plate 311, a first auxiliary plate 312 extending from a middle portion of the first main plate 311, and a first hole 3111 located in a center portion of the first main plate 311. The second portion 32 includes a second main plate 321 extending from the first auxiliary plate 312 of the first portion 31, a pair of second auxiliary plates 322 extending from the second main plate 321, and two second holes 3221 located in the second auxiliary plates 322, respectively. The two second auxiliary plates 322 are separately positioned at both sides of the second main plate 321, respectively. The third portion 33 includes a third main plate 332, a third auxiliary plate 331 extending from a middle portion of the third main plate 332 to the second main plate 321, and two third holes 3321 located in two ends of the third main plate 311, respectively.

The first portion 31 of the terminal board 30 is mounted on the upper end 110 of the cover 11 to electrically connect with the first voice coil 222. The second portion 32 of the terminal board 30 is mounted on the frame 12 to electrically connect with the second voice coil 232. The third portion 33 of the terminal board 30 is mounted on the lid 132 to electrically connect with an external circuit.

The terminal board 30 provides acoustic frequency signals to the first voice coil 222 and the second voice coil 232. Conventionally, acoustic frequency signals involve high frequency signals and low frequency signals. The high frequency signals and low frequency signals can be synchronously provided to the first voice coil 222 and the second voice coil 232, respectively. Therefore, the acoustic frequency of the low frequency signals and the high frequency signals can be both output synchronously, which effectively solves the problem of intermodulation of distortion for the high and low acoustic frequencies, and reduces the size of the speaker to be more compact.

The cover 11 further includes a first zone 111 located on the upper end 110, and a first side wall 1113 extending from an edge of the first zone 111. The first zone includes a first pit 1111 cooperating with the first main plate 311 and a first oblique portion 1112 cooperating with the first auxiliary plate 312. At least a first protrusion 112 is provided on the first pit 1111 cooperating with the first hole 3111 for fixing the first portion 31 of the terminal board 30 firmly. The pair of first pads 24 is embedded in the first pit 1111 and electrically connected with the first voice coil 222. Two ends of the first portion 31 press on the pair of first pads 24 for conducting electrical signals to the first voice coil 222. Similarly, the frame 12 includes a second zone 125 cooperating with the second main plate 321, two second protrusions 123 extending from the upper surface 121 cooperating with the second holes 3221 for positioning the second portion 32. The two second auxiliary plates 322 are respectively separately arranged both sides of the first oblique portion 1112 and mounted on the upper surface 121 for electrical connecting with the second voice coil 232 via the two second pads 25. The case 13 includes a third zone 130 cooperating with the third portion 33 of the terminal board 30. The third zone further includes a third oblique portion 1301 cooperating with the third auxiliary plate 331 and a third pit 1302 located on the lid 132 cooperating with the third main plate 332. Two third protrusions 1323 are located on the third pit 1302 accommodated the third holes 3321 for positioning the third portion 32 firmly.

In the exemplary embodiment, the first voice coil 222 and the second voice coil 232 are electrically connected with the external circuit via the first main plate 311 and second auxiliary plates 322 of the terminal board 30, respectively. A distance between the two vibrating unit and the external circuit is reduced for preventing either of the two voice coils from fracturing during the vibration of the vibrating units.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A speaker comprising:

a box having a cavity with a sound hole and defining a cover, a case and a frame sandwiched between the cover and the case;

a magnetic circuit unit received in the cavity and having a first magnetic gap and a second magnetic gap;

a first vibrating unit defining a first diaphragm and a first voice coil suspended in the first magnetic gap;

a second vibrating unit defining a second diaphragm and a second voice coil suspended in the second magnetic gap;

a pair of first pads embedded in the cover for electrically connecting with the first voice coil;

a pair of second pads embedded in the frame for electrically connecting with the second voice coil;

a terminal board mounted on the outer surface of the box and defining a first portion mounted on the cover for electrically connecting with the pair of first pads, a second portion extending from the first portion and mounted on the frame for electrically connecting with the pair of second pads, a third portion extending from the second portion and mounted on the case for electrically connecting to an external circuit.

2. The speaker as claimed in claim 1, wherein the first portion of the terminal board has a first hole, a first protrusion is provided on the cover for accommodating the first hole for positioning the first portion of the terminal board firmly; the third portion of the terminal board has a third hole, and a third protrusion is provided on the case for accommodating the third hole for positioning the third portion of the terminal board firmly.

3. The speaker as claimed in claim 2, wherein the second portion defines a main plate extending from the first portion of the terminal board, and a pair of auxiliary plates extending from the main plate of the second portion, two second holes located on the auxiliary plate, respectively, and two second protrusions are provided on the frame for accommodating the second holes for fixing the second portion of the terminal board firmly.

4. The speaker as claimed in claim 3, wherein the first portion defines a first main plate, a first auxiliary plate extending from a middle portion of the first main plate toward the second portion, the first hole located on the main plate, and a first pit is provided on the cover for cooperating with the first main plate of the first portion of the terminal board.

5. The speaker as claimed in claim 4, wherein the case has a bucket, a lid with a plurality of sound holes, and a pit located on the lid for cooperating with the third portion of the terminal board.

6. The speaker as claimed in claim 5, wherein the third protrusion is located on the pit of the lid.

7. The speaker as claimed in claim 6, wherein the frame further has an upper surface toward the cover, the two second protrusions located on the upper surface.

* * * * *